United States Patent [19]

Castoe

[11] 4,364,288

[45] Dec. 21, 1982

[54] CAMBER ADJUSTMENT ADAPTER

[76] Inventor: John H. Castoe, 10234 McVine St., Sunland, Calif. 91040

[21] Appl. No.: 223,716

[22] Filed: Jan. 9, 1981

Related U.S. Application Data

[63] Continuation-in-part of Ser. No. 99,920, Dec. 3, 1979, abandoned.

[51] Int. Cl.[3] ..... B25B 23/02

[52] U.S. Cl. ..... 81/3 R; 81/55

[58] Field of Search ..... 81/3 R, 13, 55

[56] References Cited

U.S. PATENT DOCUMENTS

| | | | |
|---|---|---|---|
| 2,417,757 | 3/1947 | Hoff | 81/55 |
| 3,736,816 | 6/1973 | McAfee | 81/3 R |
| 3,918,329 | 11/1975 | Hopkinson | 81/3 R |
| 4,193,327 | 3/1980 | Lares et al. | 81/55 |

*Primary Examiner*—James G. Smith

*Attorney, Agent, or Firm*—Christie, Parker & Hale

[57] ABSTRACT

An adapter for use in aligning the front end suspension system of a vehicle enables a mechanic, working alone, to adjust the camber setting without otherwise requiring the mechanic to remove the wheel in order to gain access to the camber adjustment bolts, or without otherwise requiring assistance of a second mechanic. The adapter comprises a generally U-shaped tool having first and second legs and a bight portion for extending around opposite sides of the housing at the base of the suspension system strut assembly where the camber adjustment bolts are located. The first leg of the U has a bore with a closed interior surface adapted for engagement with the head of a camber adjustment bolt. The opposite second leg of the U has a fastener for being tightened against the opposite face of the housing. This holds the tool in a fixed position for locking the camber bolt against rotation. After each camber bolt is adjusted to provide the proper camber setting, the tool is used to lock each camber bolt against rotation so the nut on the opposite end of the camber bolt can be tightened to torque the camber bolt the required amount. The second leg of the tool is shorter than the first leg to provide access to the torque nut adjacent the end of the second leg. The interior surface of the bore has a large number of short flats that permit locking onto the hex head of either camber bolt independently of the rotational orientation of the bolts. Stabilizing bolts on the bight portion of the U can be tightened against the housing to prevent the tool from slipping when torque is applied to each camber bolt.

17 Claims, 7 Drawing Figures

174
176
136
110
142
178
172
160
144
170
156
184
172
132
7
7
182
180

136
160
154
134
156
172
180
184
170
172
132
142

CAMBER ADJUSTMENT ADAPTER

CROSS-REFERENCE TO RELATED APPLICATION

This is a continuation-in-part of application Ser. No. 99,920, filed Dec. 3, 1979, now abandoned.

BACKGROUND OF THE INVENTION

1. Field of the Invention

This invention relates to an adapter to facilitate torquing the camber bolts of a vehicle front suspension system when making a front end alignment.

2. Description of the Prior Art

Some vehicle front end suspension systems include a pair of camber bolts on a housing at the base of a suspension system strut arm. The camber bolts are adjusted to make the desired camber setting for each hub assembly. The camber bolts are initially loosened prior to making the desired camber setting, and a nut on each camber bolt is tightened to torque each bolt a required amount after the camber setting is made. In one automobile suspension system, 140 ft.-lbs. of torque are required for each camber bolt.

Several procedures can be used to make front end alignments. For example, one procedure involves removing the wheel, loosening the camber bolts, replacing the wheel, adjusting the bolts to make the desired camber setting, partially tightening the nut on each camber bolt to avoid slippage, jacking up the front end of the vehicle, torquing the camber bolts, and then lowering the front end.

In making such a wheel alignment, the wheel is often removed after the desired camber setting is made in order to provide the mechanic with sufficient access for torquing the camber adjustment bolts. If the wheel is removed, the camber-indicating instruments must be reset and the camber adjustment checked after the wheel is replaced to ensure a correct reading. In many instances the camber setting will change after the camber bolts are torqued and the wheel is replaced. It often requires more than the allowed shop time to perform a front end alignment where the electronic insturments must be reset after the wheel is replaced.

A front end alignment can be performed without removing the wheel, but this requires two mechanics, one mechanic for holding the head of each camber bolt while the other mechanic torques the camber bolts. If the wheel is not removed, it produces such a large obstruction that one mechanic, working alone, cannot simultaneously reach the head of the camber bolt to hold it in place and also reach the nut on the other end of the bolt with a torque wrench and then be able to adequately torque the bolt.

It would be desirable for one mechanic, working alone, to perform a front end alignment while avoiding removal of the wheel, so as not to require assistance of a second mechanic and so that the instruments can be left in place to continuously indicate the correct camber reading, while saving time otherwise used in resetting the instruments, not to mention the added time required to remove and replace the wheel.

SUMMARY OF THE INVENTION

Briefly, this invention provides an adapter for use in torquing a camber bolt installed in a housing in a vehicle front end suspension system. The housing has a pair of opposed first and second faces, and the camber bolt has a hex head adjacent a first face of the housing. A torque nut is secured to an end of the camber bolt adjacent a second face of the housing. The nut can be tightened to torque the camber bolt. One embodiment of the adapter comprises a generally U-shaped tool having opposed first and second legs with a bight portion that extends around the housing so the first and second legs of the tool can overlie the first and second faces of the housing, respectively. A bore extending through the first leg has a closed interior surface for being releasably secured to the hex head of the camber bolt. A fastener on the second leg can be tightened against the second face of the housing to hold the tool in a fixed position to lock the camber bolt against rotation while the bolt is being torqued by tightening the torque nut on the camber bolt. The second leg of the tool is shortened relative to the first leg of the tool to provide access to the torque nut adjacent the end of the second leg of the tool.

In one embodiment, fastener means on the bight portion of the U can be tightened against the housing to prevent the tool from tipping when the camber bolt is being torqued.

The adapter provides means for allowing one mechanic, working alone, to avoid removing the wheel of the vehicle when adjusting the camber setting. The tool holds the camber bolts in place while all of the mechanic's effort can be used in torquing each camber bolt. Since the wheel is left in place, the instruments used in setting the camber also can be left in place, so they do not require resetting. Since the adapter holds each camber bolt in place, the mechanic does not require the assistance of another mechanic in making the camber settings.

These and other aspects of the invention will be more fully understood by referring to the following detailed description and the accompanying drawings.

DRAWINGS

DETAILED DESCRIPTION

Figure 1:
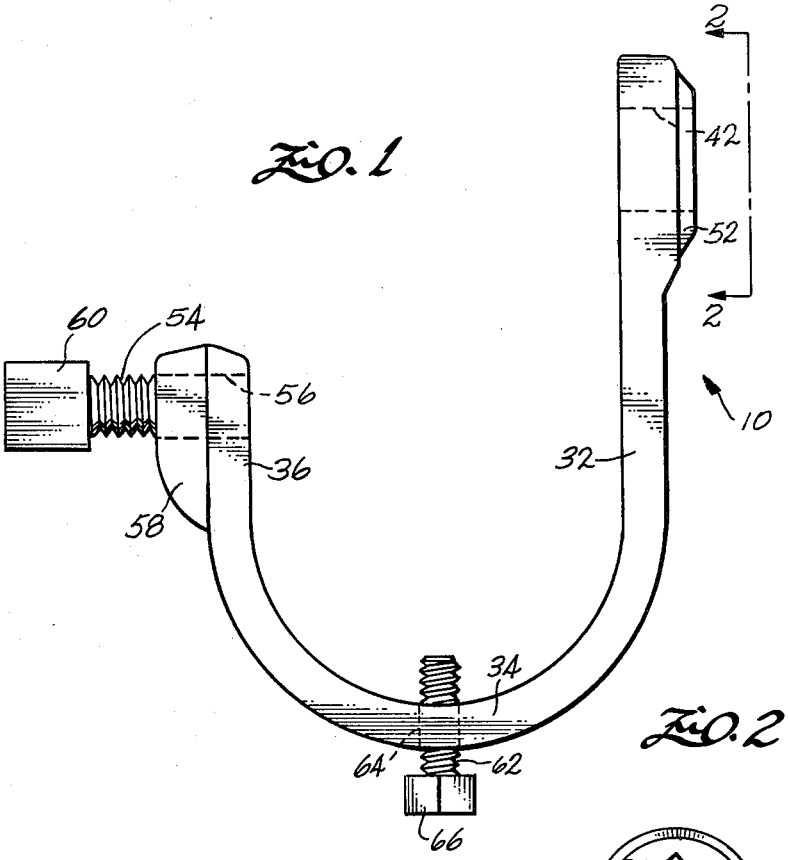
FIG. 1 is an elevation view showing an adapter according to principles of this invention.
Figure 2:
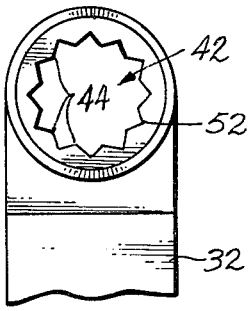
FIG. 2 is a fragmentary end elevation taken on line 2—2 of FIG. 1.
Figure 3:
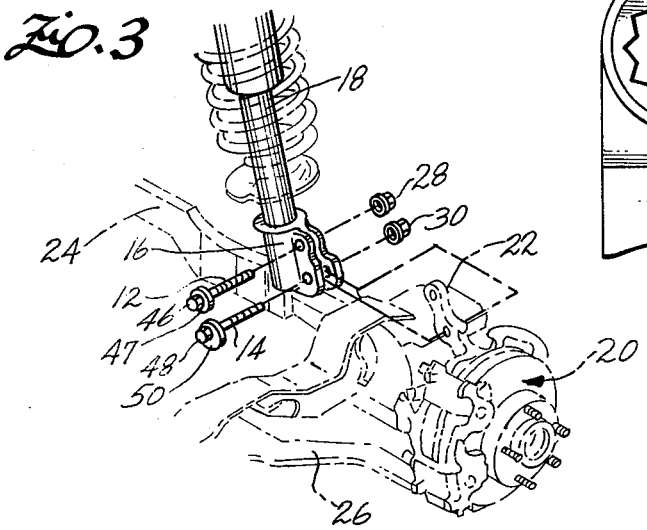
FIG. 3 is a perspective view showing a front end suspension system with which the adapter is used.

FIG. 1 shows a camber adjustment adapter 10 according to principles of this invention. The configuration and use of the adapter is best understood by initially referring to FIG. 3, which illustrates an automobile front end suspension system. A pair of camber bolts, also referred to herein as an upper pivot bolt 12, and a lower cam bolt 14, are located on a housing 16 at the base of a generally upright strut arm 18. The strut arm housing is secured to a hub assembly 20 by the camber bolts. Opposite portions of the housing sandwich an arm 22 of the hub assembly, and the camber bolts extend through the housing and through the arm 22 for fastening the strut arm to the hub assembly. A suspension system cross-member 24 and a lower steering control arm 26 also are shown in FIG. 3. A first torque nut 28 and a second torque nut 30 are threaded onto opposite ends of the pivot bolt and the cam bolt, respectively, and are torqued a preselected amount to tightly secure the strut arm to the hub assembly.

The adapter comprises a generally U-shaped tool having a first leg 32, a bight portion 34 and a second leg 36 spaced from and extending generally parallel to the first leg. The first leg is longer than the second leg of the U. The first and second legs are spaced apart by a distance equal to the distance between a first face 38 and a second face 40 of the housing 16. The first and second legs have generally flat, parallel inside surfaces for overlying the first and second faces, respectively, of the housing, while the bight portion of the bracket extends around the side of the housing. The tool is made from a rigid material, preferably metal such as steel.

Figure 4:
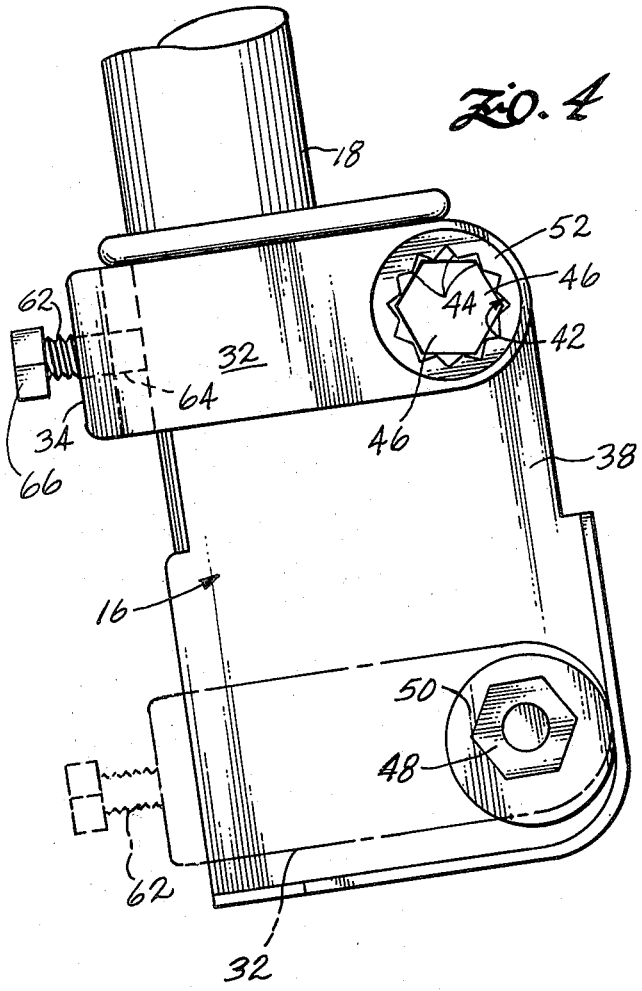
FIG. 4 is a fragmentary elevation view showing the adapter in use on a housing having a pair of camber adjustment bolts.

A first bore 42 extends through an end portion of the first leg 32. The bore has a closed interior surface comprising a series of short lands 44 of a saw-tooth pattern around a circle that defines the internal surface of the bore. The lands are arranged to releasably engage the exterior flats on the hex head of each camber adjustment bolt. As shown in FIG. 4, the pivot bolt 12 has a hex head 46 rigidly secured to a washer 47, and the cam bolt 14 has a hex head 48 rigidly secured to a cam 50. The interior surface of the first bore 42 is adapted to engage either hex head, independently of their rotational orientation. Thus, regardless of how either camber bolt is rotated to make the desired camber setting, the U-shaped adapter can be slipped around the side of the housing and the bore locked onto the head of either camber bolt. The bore has a number of lands in excess of six that are shorter than the six flats on either hex head. In the preferred embodiment, there are twelve short lands that engage the flats on either hex head and lock the hex head in the bore. This locks the camber bolt against rotation as long as the tool is held in a fixed position.

Although the bore is shown in the tool for locking the hex head against rotation, a tool with an open-ended notch, such as an open-ended wrench, also could be used.

The exterior surface portion of the first leg can have a raised portion 52 that sourrounds the bore first 42. The lands 44 extend through the raised portion 52, as well as the main portion of the first leg 32. The added thickness of the raised portion provides added means for ensuring a good grip on either camber adjustment bolt 46 or 48.

A fastener such as a bolt 54 having a threaded shank is threaded into an internally threaded second bore 56 in an end portion of the second leg 36. The second bore 56 is internally threaded not only through the main portion of the second leg, but also through the raised portion 58 that surrounds the bore. This provides means for ensuring engagement between the bolt 54 and the bore 56 when the bolt is loosened. A square head 60 on the bolt 54 facilitates turning the bolt relative to the second leg 36 of the tool.

A tool stabilizing fastener such as a bolt 62 having a threaded shank is threaded into an internally threaded bore 64 extending through the bight portion 34 of the U. A square head 66 facilitates turning the stabilizing bolt 62 relative to the bight portion of the tool so the end of the bolt can be adjusted with respect to the bight portion of the U.

The axis of the first bore 42 is offset from the axis of the second bore 56 owing to the longer length of the first leg 32 of the U. Both axes are parallel and intersected by the axis of the bore 64 which receives the stabilizing fastener 62.

Figure 5:
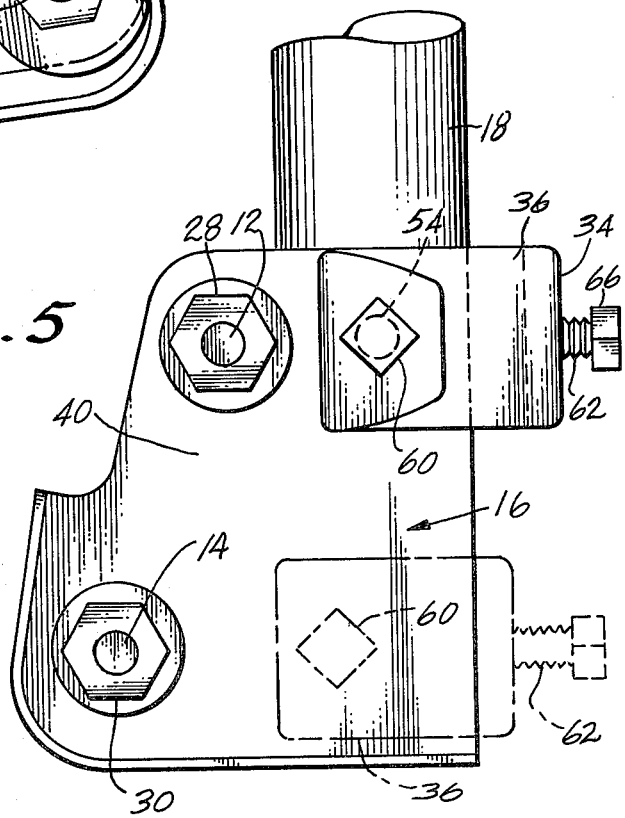
FIG. 5 is a fragmentary, elevation view taken from a side of the housing opposite that of FIG. 4, and also showing the adapter during use.

In use, the U-shaped adapter is placed around the side of the housing 16, as shown in FIG. 4, so the first leg 32 of the U overlies the first face 38 of the housing with the lands 44 of the bore 42 locked to the hex head 46 of the pivot bolt 12. The second leg of the U overlies the second face 40 of the housing 16, and the bolt 54 is tightened against the housing to hold the adapter in a fixed position around the housing. The stabilizing bolt 62 is tightened against the housing also to prevent tipping of the tool when the torque nut is being tightened, especially when the bight portion 34 is spaced from the housing as shown at the top of FIGS. 4 and 5. This attachment of the tool to the housing locks the pivot bolt against rotation. The mechanic can easily install the adapter in this manner while leaving the wheel in place. The mechanic is than able to torque the pivot bolt with a torque wrench placed on the nut 28. The mechanic is able to use both hands to torque the bolt to its required amount, since the mechanic need not be concerned with also locking the pivot bolt against rotation. Access to the pivot bolt is thereafter easily available with the wheel in place on the hub assembly. The second leg 36 of the adapter is shorter than the first leg so the end of the second leg is spaced from the nut 28 on the pivot bolt when the adapter is fastened in place. The second leg is sufficiently short to provide good access to the nut 28 by the torque wrench without interference from the adapter. The adapter can be released from its locked position by loosening the bolt 52. The bore of the adapter then can be applied to the hex head 48 of the cam bolt 14 and the opposite side of the adapter fastened to the housing by tightening the bolt 54. The cam bolt 14 then can be torqued by tightening the nut 30. The interior surface configuration of the bore allows the adapter to lock onto each hex head independently of the position of either hex head after the camber settings are made. Although one hex head is offset laterally from the other, the legs of the U-shaped adapter are sufficiently long to accommodate this offset to reach either of the camber bolts.

Figure 6:
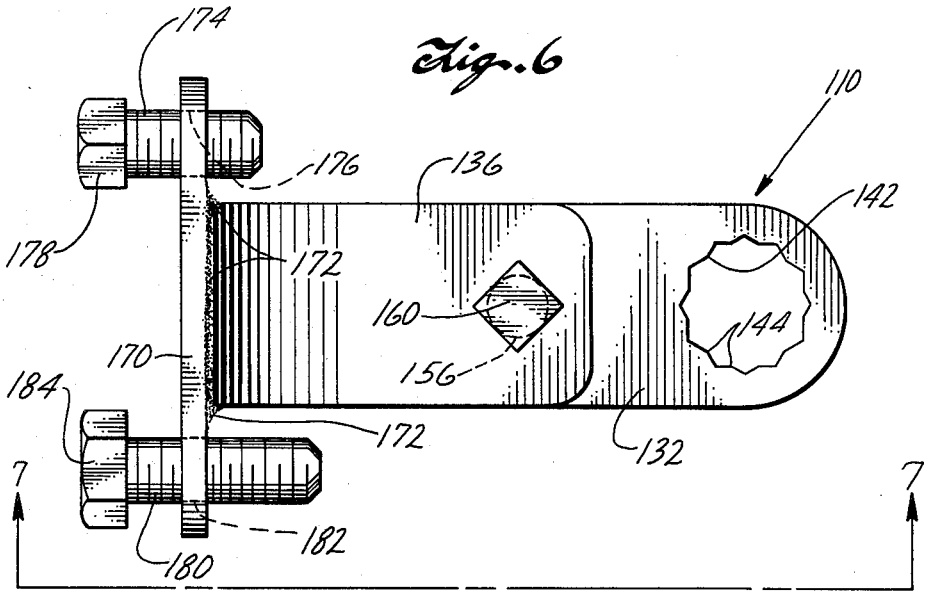
FIG. 6 is an elevation view illustrating an alternative form of the camber adjustment adapter.
Figure 7:
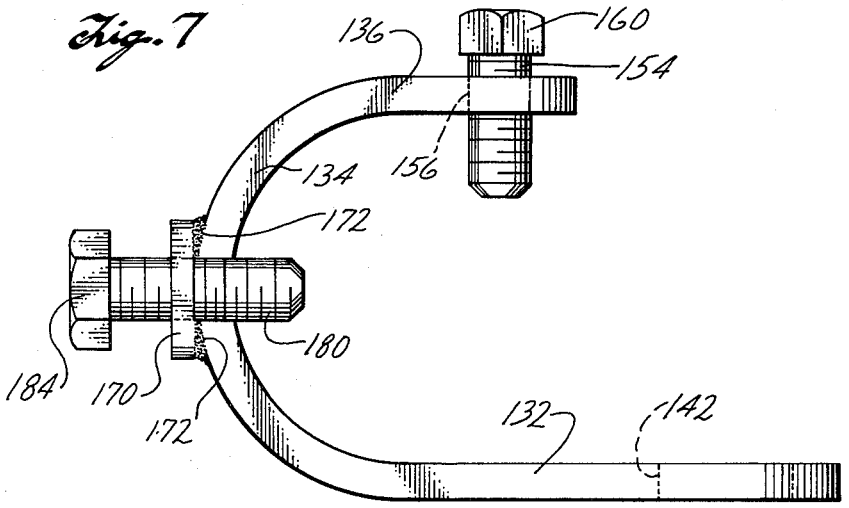
FIG. 7 is an elevation view taken on line 7—7 of FIG. 6.

FIGS. 6 and 7 show an alternative camber adjustment adapter 110 in which the U-shaped tool is similar to the U-shaped tool described in FIGS. 1 through 5, and in which 100 has been added to reference numerals in FIGS. 6 and 7 to indicate similar elements of the tool described in FIGS. 1 through 5. The alternative camber adjustment adaper inclues bracket stabilizing means having fasteners on an elongated flat, rigid metal stabilizing bar 170, instead of the stabilizing bolt 62 described above. The bar is rigidly affixed to the bight portion 134 of the U by welding 172. The length of the stabilizing bar is greater than the width of the U, so that opposite end portions of the stabilizing bar extend beyond the opposite side edges of the U, as shown best in FIG. 6. Stated another way, the bar extends along an axis that intersects the plane of the U. In the illustrated embodiment, the bar is perpendicular to the plane of the U.

Separate fasteners extend through the outwardly projecting end portions of the stabilizing bar. These fasteners include a first stabilizing bolt 174 having a threaded shank threaded into engagement with an internally threaded bore 176 in one end portion of the stabilizing bar. The first stabilizing bolt has a hex head 178 for turning the bolt about its axis so that the end portion of the bolt can move axially into the U. i.e., toward the ends of the first and second legs when the bolt is tightened relative to the stabilizing bar. A second stabilizing bolt 180 has a threaded shank threaded into engagement with an internally threaded bolt 182 in the opposite end portion of the stabilizing bar. The second stabilizing bolt also has a hex head 184 for turning the bolt about its axis so the end portion of the second stabilizing bolt can be moved into the U, i.e., toward the ends of the U when the bolt is tightened relative to the stabilizing bar. The two stabilizing fasteners are generally parallel to each other and each is spaced outwardly from an adjacent side edge of the U.

The tool illustrated in FIGS. 6 and 7 is used in a manner similar to that shown in FIG. 4 so that the first leg 132 of the U overlies the first face 38 of the housing with the lands 144 of the bore 142 locked to the hex head 46 of the pivot bolt 12. The second leg of the U overlies the second face 40 of the housing 16, and the bolt 154 is tightened against the housing to hold the adapter in a fixed position around the housing. The stabilizing bar extends adjacent the end of the housing opposite the camber bolts, and the stabilizing bolts are tightened against the housing and/or the strut arm 18 to stabilize the tool to prevent the tool from tipping when the torque nut is being tightened. By tightening the stabilizing bolts against the housing and/or strut arm, the stabilizing bolts provide two points which are spaced from opposite sides of the U and at which the U is stabilized with respect to the strut housing. This additional means of stabilizing the tool ensures that the tool will not slip from its fixed position when the large amounts of torque are applied to the torque bolts.

In the embodiment illustrated in FIGS. 6 and 7, the two stabilizing bolts are of different length. The second stabilizing bolt is longer since, for certain strut housing designs, one bolt has to reach farther than the other bolt. For example, when one bolt is being tightened against the strut arm instead of the housing, the bar is spaced farther from the strut than the housing, so one fastener is longer to accommodate the increased distance.

Thus, the camber adjustment tool can be installed by a mechanic and then the mechanic can torque each camber bolt by himself while the wheel is left with the instruments intact. This saves time otherwise required to remove and replace the wheel and reset the instruments, and does not require the assistance of another mechanic to properly torque the camber bolts.

I claim:

1. An adapter for use in torquing a camber bolt installed in a housing of a strut assembly in a vehicle suspension system, the housing having a pair of opposed first and second faces in which the camber bolt has a head adjacent the first face of the housing and torque nut is secured to an end of the camber bolt adjacent the second face of the housing, so the torque nut can be tightened to torque the camber bolt, the adapter comprising a generally U-shaped bracket having opposed first and second legs and a bight portion for extending around a side of the housing so the first and second legs can overlie the first and second faces of the housing; a bore extending through the first leg of the bracket, the bore having an interior surface for being releasably secured to the head of the camber bolt; a fastener on the second leg for being rotated relative to the second leg for tightening the fastener against the second face of the housing to hold the first leg in a fixed position with the bore being locked around the head of the camber bolt to prevent rotation of the camber bolt while the torque nut is tightened to torque the camber bolt, the second leg being shorter than the first leg so the axis of the fastener is spaced inwardly closer to the bight portion of the bracket than the axis of the bore in the first leg for providing access to the torque nut adjacent the end of the second leg of the bracket; and at least one adjustable stabilizing fastener on the bight portion of the U-shaped bracket for being moved toward the U formed by the bracket for tightening the bracket around the housing.

2. Apparatus according to claim 1 in which the bore has a closed interior surface for locking onto the head of the torque nut.

3. Apparatus according to claim 1 in which the interior surface of the bore includes a series of more than six lands in a saw-tooth pattern.

4. Apparatus according to claim 1 in which the interior surface of the bore provides means for locking the second leg around a hex head independently of the rotational orientation of the hex head so that the bracket can be locked onto the hex head without first rotating it.

5. An adapter for use in torquing a camber bolt installed in a housing of a strut assembly in a vehicle suspension system, the housing having a pair of opposed first and second faces, in which the camber bolt has a head adjacent the first face of the housing and a torque nut is secured to an end of the camber bolt adjacent the second face of the housing, so the torque nut can be tightened to torque the camber bolt, the adapter comprising a generally U-shaped bracket having opposed first and second legs and a bight portion for extending around a side of a housing so the first and second legs can overlie the first and second faces of the housing; a bore extending through the first leg of the bracket, the bore having an interior surface for being releasably secured to the head of the camber bolt; a fastener on the second leg for being rotated relative to the second leg for tightening the fastener against the second face of the housing to hold the first leg in a fixed position with the bore being locked around the head of the camber bolt to prevent rotation of the camber bolt while the torque nut is tightened to torque the camber bolt; and at least one adjustable stabilizing fastener carried on the bight portion of the U-shaped bracket for being moved toward the U formed by the bracket for tightening the bracket around the housing.

6. Apparatus according to claim 5 in which the stabilizing fastener is movable along an axis which is spaced from and extends between and is generally parallel to the first and second legs of the U-shaped bracket.

7. An adapter for use in torquing a camber bolt installed in a housing of a strut assembly in a vehicle suspension system, the housing having a pair of opposed first and second faces, in which the camber bolts has a head adjacent the first face of the housing and a torque nut is secured to an end of the camber bolt adjacent the second face of the housing, so the torque nut can be tightened to torque the camber bolt, the adapter comprising a generally U-shaped bracket having opposed first and second legs and a bight portion for extending around a side of the housing so the first and second legs can overlie the first and second faces of the housing; a bore extending through the first leg of the bracket, the bore having an interior surface for being releasably secured to the head of the camber bolt; a fastener on the second leg for being rotated relative to the second leg for tightening the fastener against the second face of the housing to hold the first leg in a fixed position with the bore being locked around the head of the camber bolt to prevent rotation of the camber bolt while the torque nut is tightened to torque the camber bolt; an elongated stabilizing bar rigidly affixed to the bight portion of the bracket and extending in a direction that intersects the plane of the U-shaped bracket so that opposite end portions of the stabilizing bar are spaced from opposite sides of the U-shaped bracket; and separate stabilizing fasteners on the opposite end portions of the stabilizing bar for being rotated relative to the stabilizing bar for moving the stabilizing fasteners toward the ends of the first and second legs of the U-shaped bracket for tightening the stabilizing fasteners against the housing for stabilizing the bracket in said fixed position around the housing.

8. Apparatus according to claim 7 wherein the stabilizing fasteners are generally parallel to one another and generally parallel to the plane of the U-shaped bracket.

9. Apparatus according to claim 7 in which each stabilizing fastener extends along an axis which is spaced from and extends between and is generally parallel to the first and second legs of the U-shaped bracket.

10. Apparatus according to claim 7 in which the second leg of the U-shaped bracket is shorter than the first leg so the axis of the fastener in the second leg of the bracket is spaced inwardly closer to the bight portion of the bracket than the axis of the bore in the first leg of the bracket for providing access to the torque nut adjacent then end of the second leg of the bracket.

11. Apparatus according to claim 10 in which the bore has a closed interior surface for locking onto the head of the torque nut.

12. Apparatus according to claim 7 in which the bore has a closed interior surface for locking onto the head of the torque nut.

13. Apparatus according to claim 1 including a second adjustable stabilizing fastener spaced from the other stabilizing fastener and carried on the bight portion of the U-shaped bracket for being moved toward the U formed by the bracket for further tightening the bracket around the housing.

14. Apparatus according to claim 5 including a second adjustable stabilizing fastener spaced from the other stabilizing fastener and carried on the bight portion of the U-shaped bracket for being moved toward the U formed by the bracket for further tightening the bracket around the housing.

15. Apparatus according to claim 14 in which the stabilizing fasteners are movable along separate axes which are spaced from and extend between and are generally parallel to the first and second legs of the U-shaped bracket.

16. Apparatus according to claim 7 in which one stabilizing fastener is shorter than the other.

17. Apparatus according to claim 10 in which one stabilizing fastener is shorter than the other.

* * * * *